United States Patent [19]

Bonner et al.

[11] Patent Number: 4,808,069

[45] Date of Patent: Feb. 28, 1989

[54] ANTI-ROTATION GUIDE VANE BUSHING

[75] Inventors: George Bonner, Palm Beach Gardens; Milo R. Rodriguez, West Palm Beach; Douglas L. Kisling, Palm Beach Gardens, all of Fla.

[73] Assignee: The United States of America as represented by the Secretary of the Air Force, Washington, D.C.

[21] Appl. No.: 881,741

[22] Filed: Jul. 3, 1986

[51] Int. Cl.[4] ..... F04D 29/56

[52] U.S. Cl. ..... 415/160; 384/435; 411/92

[58] Field of Search ..... 415/160–164, 415/156, 140, 141; 384/428, 435, 911; 411/92–100, 990

[56] References Cited

U.S. PATENT DOCUMENTS

| | | | |
|---|---|---|---|
| 570,917 | 11/1896 | Eisele | 411/990 X |
| 782,822 | 2/1905 | Bryan et al. | 411/95 |
| 1,051,188 | 1/1913 | Bandy | 411/94 |
| 1,142,192 | 6/1915 | Morgan | 411/990 X |
| 2,423,918 | 7/1947 | Wohlhieter | 411/97 |
| 3,303,992 | 2/1967 | Johnson | 415/160 X |
| 3,489,196 | 1/1970 | Stock | 411/96 |
| 3,538,579 | 11/1970 | Sprenger | 29/200 |
| 3,542,484 | 11/1970 | Mason | 415/160 |
| 3,695,777 | 10/1972 | Westphal et al. | 415/160 X |
| 3,788,763 | 1/1974 | Nickles | 415/147 |
| 3,850,544 | 11/1974 | Ciokajlo | 415/149 |
| 4,054,337 | 10/1977 | Matt et al. | 384/911 X |
| 4,363,600 | 12/1982 | Thebert | 415/156 |
| 4,498,790 | 2/1985 | Fisher | 384/428 |

*Primary Examiner*—Robert E. Garrett
*Assistant Examiner*—Joseph M. Pitko
*Attorney, Agent, or Firm*—Jules J. Morris; Donald J. Singer

[57] ABSTRACT

A variable guide vane 12 bushing assembly 10 which features means that prevents bushing rotation. A bushing 16 comprises flats 16*b* on its outer sleeve, the flats interlock with race track shaped holes 20*a* on a tab-lock washer 20. The tab-lock washer spans two or more adjacent vane stems (12,14) and thus is not susceptible to rotation. A retainer 24 and the vane arm 26 assemble on top of the tab-lock washer to complete the assembly.

9 Claims, 1 Drawing Sheet

ANTI-ROTATION GUIDE VANE BUSHING

STATEMENT OF GOVERNMENT INTEREST

The invention described herein may be manufactured and used by or for the Government for governmental purposes without the payment of any royalty thereon.

TECHNICAL FIELD

This invention relates to bushings for variable guide vanes used in gas turbine engines.

BACKGROUND OF THE INVENTION

Gas turbine engine compressors usually comprise multiple stages of rotating blades that are used to compress air prior to combustion. Interspaced between the stages of rotating blades are vane stages which are used to direct compressor air flow in a manner that maximizes compressor efficiency. Some vane stages are adjustable so that the compressor can adapt itself to a variety of engine operating conditions by varying vane angle. Vanes in variable stages are therefore adjusted in order to direct compressor air flow; multiple vanes are ganged together for operation in unison by actuators.

In this type of mechanism, vane stems extend through the engine casing so that the vanes may be attached to vane arms. Vane stem bushings are used in order to provide an adequate bearing surface between vane stems and engine casing and to prevent engine compressor air from escaping the engine casing. Either plastic or metal bushings are used in this type of arrangement.

Several problems are related to use of conventional vane bushings. One serious problem is excessive bushing wear on the bushing outer diameter where it contacts the engine casing. This wear is a result of bushing auto-rotation due to engine vibration; rotational movement due to vibration can rapidly wear out the bushing and ruin its sealing and bearing properties. This type of vane bushing rotation occurs independently of vane stem rotation. Although the bushing may initially be tightly installed in the engine casing, slight movement during engine operation may produce wear that later allows substantial movement and bushing damage.

Another problem that has occurred with the user of conventional vane stem bushings is the loss of pressurized air from the compressor. This problem most often occurs at the inlet guide vane stage where there is insufficient internal air pressure to properly seat the bushing and form a good air seal. In higher compressor stages, where the internal air pressure is substantially higher, bushings will generally seat and form a tight air seal. Air loss from a multitude of bushings surrounding vane steams can have an adverse affect on compressor efficiency since it results in less air flowing through the engine to do useful work in the turbine.

Objects of this invention include providing a bushing assembly that restricts bushing rotation and reduces pressurized air leakage from the compressor.

BRIEF DESCRIPTION OF THE INVENTION

The invention comprises a variable guide vane bushing assembly which includes a bushing, a lock washer and a retainer. The bushing preferably has a sleeve and collar portion. The sleeve portion is slid onto a vane stem and the collar portion is positioned adjacent to the vane. In the preferred embodiment of the invention two flat portions are formed on the sleeve of the bushing where it projects from the compressor casing.

The lock washer has two race track shaped openings that mate with the sleeves of adjacent bushings where they project from the compressor casing. The flat portions of the race track shaped openings align with the flat portions of the bushing sleeves and prevent bushing rotation.

The retainer is substantially square shaped and fits within prebent tabs formed on the lock washer. Thus the retainer is prevented from rotation by the tabs of the lock washer. In the preferred embodiment of the invention an interference fit is formed between the retainer and the sleeve of the bushing. This helps ensure a tight air seal across the engine case.

In the preferred embodiment of the invention the vane stem assembly retains the bushing assembly in a manner which prevents diametral movement of the assembly.

BRIEF DESCRIPTION OF THE DRAWINGS

The foregoing and other objects and advantages of the invention will be apparent from the following more particular description of the preferred embodiment of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figure 1:
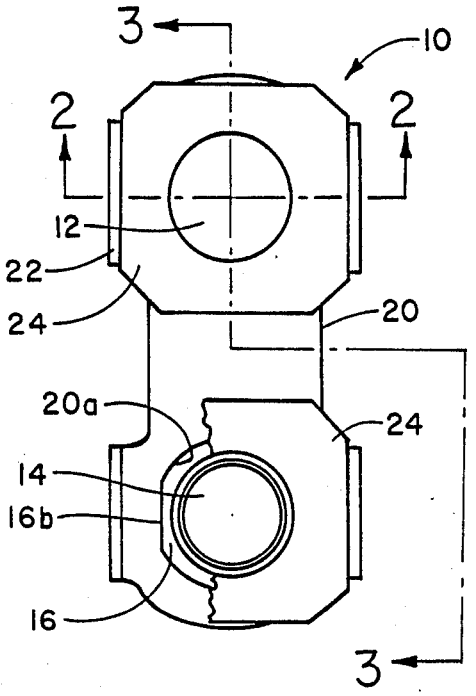
FIG. 1 is a top view of a bushing assembly with a portion of a retainer removed and which embodies the principles of this invention.
Figure 2:
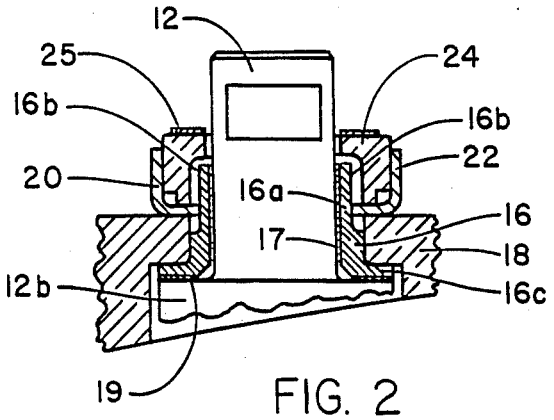
FIG. 2 is a partial cross section of the bushing assembly of FIG. 1 taken across line 2—2 of FIG. 1.

FIG. 1 is a top view of a variable guide vane bushing assembly 10. Referring both to FIG. 1 which has been partially broken away, and the cross section of FIG. 2, the vane bushing assembly 10 is shown to comprise a vane stem bushing 16, a lock washer 20 and a retainer 24.

The vane stem bushings 16 are initially assembled to the compressor case 18 prior to assembly of the vanes 12, 14 to the compressor case 18. The bushing collar **16*c* seats adjacent to the vane step 12*b* and the bushing sleeve 16*a* extends through the compressor casing 18**. The bushing forms a tight interference fit with the case and therefore will not accidentally fall out during assembly.

The bushing 16 is preferably made of a flexible material such as plastic or metal. A fabric liner 17, generally made from Teflon cloth or similar material, is attached to the bushing sleeve **16*a* where it contacts vane stem 12. The fabric liner 17 forms a self-lubricating bearing surface for the rotatable vane stem. The bushing also has a fabric pad 19 where the bushing contacts the vane step 12*b*** in order to provide a self-lubricating bearing surface therebetween.

After the bushings are assembled to the compressor case 18, vane stems 12, 14 are then positioned in the compressor case. Bushing 16 has two flats **16*b* which are aligned parallel to the ring of vane stems when the bushing is inserted into the compressor case. In order to trap the bushing in that position and prevent its rotation relative to the compressor case, the tab lock washer 20** is assembled onto the bushing.

Tab lock washer 20 spans and locks against rotation two adjacent bushings. The washer 20 has two race track shaped openings 20*a* which correspond to the flats 16*b* of the bushing sleeve 16*a*. The washer interlocks with the flats on the bushing sleeve and thereby prevents its rotation. In order to prevent rotation of the assembled bushing 16 and lock washer 20, the lock washer spans adjacent vane stems (12, 14) to use the adjacent vane stem bushings to resist the rotational forces on the individual bushings. The lock washer 20 therefore restrains both bushings on the adjacent vanes 12, 14 from rotation.

Figure 3:
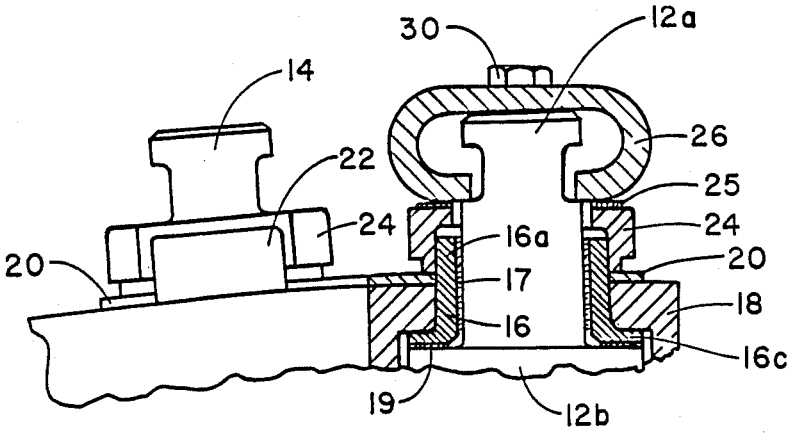
FIG. 3 is a partial side cross section of the bushing assembly of FIG. 1 taken across line 3—3 of FIG. 1.

FIG. 3 which is a partial cross section taken across line 3—3 of FIG. 1, shows lock washer 20 spanning the two adjacent vane stems 12, 14 and in addition shows a vane arm 26. In some instances it may be possible and desirable to gang together as many as three or four adjacent vane stems with one lock washer. The lock washers must be sufficiently flexible, however, so that when assembled they will be able to correspond to the circular shape of the compressor case 18.

The lock washer 20 also comprises four prevent tabs 22; inserted into these tabs are square shaped retainers 24. The retainers 24 complete the diametral stack between the compressor case 18 and the vane stem assembly 26. The retainers have fabric pads 25 on their surface most adjacent to the vane arm 26. This provides a self-lubricating bearing surface adjacent between the stationary retainer and the movable vane arm.

The square shaped retainers 24 perform an important purpose in completing the bushing fit around the vane stems 12 and 14. When the vane arm is assembled on top of the bushing assembly the retainer acts to introduce the necessary squeezing pressure between the bushing, retainer and compressor case to provide interference fits therebetween.

The interference, or tight fits provide for both smooth movement of the rotatable components and reduce compressor air leakage. Two interference fits are formed at the outer surface of bushing sleeve 16*a* one is between the bushing 16 and the compressor case 18 and the other is between the bushing and the retainer 24. Since there is no movement between these components no bearing surfaces are provided.

Tight fits are also formed between retainer 24 and vane arm 26 at fabric pad 25 and between bushing flange 16*c* and vane step 12*b* at fabric pad 19. Since these components move relative to each other bearing material is provided.

The tight fit at fabric pad 19 in conjunction with the tight fit at the outer surface of bushing sleeve 16 act to reduce compressor air leakage. Compressor air leakage from a number of vane stems can severely affect engine efficiency since leakage of pressurized compressor air diminishes the air flow into the engine's combustion chamber.

The bushing sleeve's configuration allows easy installation of the bushing to a point which permits engagement of the lock washer prior to the establishment of interference fits between the elements. Specifically, the bushings are stepped (FIG. 2) and tab lock washers sized to facilitate assembly. Tab lock washer 20 with flat sided holes 20*a* positively prevents rotation of the bushing while prebent tabs 22 prevent rotation of the retainer. The rabs 22 are sized to align the square sided retainer 24 and guide the formation of the interference fits between the retainer, the bushing and the case 18.

As a result of the interference fits and the anti-rotation features, bushing rotation has been eliminated and air leakage greatly reduced. Engine vibration during operation cannot cause excess wear and fretting on bushings 16 since they are locked into position by tab lock washer 20 and retainer 24.

During vane angle changes the bushing 16 forms a tight sleeve bearing for vane rotation and, in addition, permits very little diametral play that might otherwise cause fretting. Diametral play is the radial movement of the vanes in and out relative to the compressor case 18. Such diametral play of the vanes can cause damage to both the vanes and the bushings.

The features of this device which reduce diametral play are most readily understood with reference to FIG. 3. A vane arm 26 is bolted by nut 30 to the head 12*a* of vane stem 12 to connect the vane to actuation means. The lower edge of the assembled vane arm 26 abuts retainer 24 at fabric pad 25. The retainer 24 in turn tightly abuts tab lock washer 20 which sits directly on the compressor case 18. Tightening the vane arm 26 to the head of the vane stem 12 pushes the retainer towards the compressor case 18 to establish the interference fits. The tightening down of the vane arm also, as a reaction to the downward pressure of the retainer 24, draws the vane step 12*b* tightly against the bushing collar 16*c* at fabric pad 19. The dimensional stack of these assembled components is such that clearance space is reduced and vane stem diametral movement in and out of the compressor case 18 is minimized. This prevents fretting and wear on bushing flange, or collar, 16*c* and provides a bearing and seating surface for the vane step 12*b*.

The invention as shown and described provides a straightforward and effective way of preventing guide vane bushing wear on gas turbine engines. The guide vanes bushings are designed to provide easy assembly and an anti-rotative feature. Use of guide vane bushings of this design reduces engine maintenance and the need to periodically replace vane bushings. Further, engine efficiency should be improved through the reduction in pressurized air leakage. Use of this invention is most advantageous on inlet guide vane stages that are most susceptible to autorotation of vane bushings due to relatively low seating pressure.

While the invention has been particularly described with reference to the preferred embodiment thereof, it will be understood by those skilled in the art that various changes in substance and form can be made therein without having departed from the spirit and the scope of the invention as detailed in the attached claims.

We claim:

1. A variable guide vane bushing assembly for use in a compressor casing comprising:

(a) bushings for use on a rotatable vane stem of a guide vane, each of said bushings comprising sleeve and collar portions wherein said sleeve portions have a flat portion positioned on their periphery;

(b) bushing antirotation means comprising a lock washer having openings that mate with the flat portion of said sleeves of said bushings on at least two adjacent vane stems in order to prevent bushing rotation; and (c) retainer means to radially restrain said lock washer.

2. The variable guide vane bushing assembly of claim 1 wherein said lock washer further comprises flanges hat interlock with said retainer means.

3. The variable guide vane bushing assembly of claim 2 wherein said retainer means comprises square shaped retainers which are aligned by said flanges of said lock washer.

4. The variable guide vane bushing assembly of claim 3 wherein said retainer has a fabric pad for forming a bearing surface with said vane arm.

5. The variable guide vane bushing assembly of claim 1 wherein said bushings are fabric lined.

6. The variable guide vane bushing assembly of claim 1 wherein said lock washer has race track shaped holes for mating with the flat portions of said bushings.

7. The variable guide vane bushing assembly of claim 1 wherein said guide vane assembly is captured by a vane arm aligning a multitude of variable guide vanes.

8. The variable guide vane bushing assembly of claim 1 wherein an interference fit is formed between said bushing and said compressor casing.

9. The variable guide vane bushing assembly of claim 1 wherein an interference fit is formed between said each retainer and the sleeve portion of each of said bushings.

* * * * *